United States Patent [19]

Maehara

[11] Patent Number: 4,945,830

[45] Date of Patent: Aug. 7, 1990

[54] OFF-SET PRINTING MACHINE FOR PRINTING CONTINUOUS WEB

[75] Inventor: Kenso Maehara, Hiroshima, Japan

[73] Assignee: Ryobi Ltd., Hiroshima, Japan

[21] Appl. No.: 251,480

[22] Filed: Sep. 30, 1988

[30] Foreign Application Priority Data

Sep. 30, 1987 [JP] Japan ..... 62-150883

[51] Int. Cl.[5] ..... B41F 7/04; B41F 13/14

[52] U.S. Cl. ..... 101/217; 101/248; 101/228

[58] Field of Search ..... 101/216, 219, 248, 217, 101/218, 142–143, 177, 228

[56] References Cited

U.S. PATENT DOCUMENTS

| | | | |
|---|---|---|---|
| 3,474,727 | 10/1969 | Kampf | 101/219 |
| 4,057,012 | 11/1977 | Heidemann | 101/219 X |
| 4,350,093 | 9/1982 | Ishii | 101/217 |
| 4,512,256 | 4/1985 | Schriber et al. | 101/219 X |
| 4,527,472 | 7/1985 | Davison | 101/219 |
| 4,549,485 | 10/1985 | Nawrath | 101/219 |
| 4,563,950 | 1/1986 | Fischer | 101/219 X |
| 4,785,734 | 11/1988 | Kawana et al. | 101/219 |
| 4,817,525 | 4/1989 | Yagi | 101/219 |

*Primary Examiner*—J. Reed Fisher

*Attorney, Agent, or Firm*—Sughrue, Mion, Zinn, Macpeak & Seas

[57] ABSTRACT

An off-set printing machine for printing a continuous web includes a first pair of gears 12*c*, 14*b* in mesh with each other, one gear being fixedly mounted coaxially on one of blanket and impression cylinders 12, 14 for rotation therewith while the other gear is rotatably mounted coaxially on the other of the cylinders and is releasably fixable thereto for rotation therewith. There are provided a second pair of gears 12*b*, 10*b* in mesh with each other, one of the second pair of gear being fixedly mounted coaxially on one of the blanket and plate cylinders 12, 10 for rotation therewith while the other of the second pair of gears is rotatably mounted coaxially on the other of the blanket and plate cylinders and is releasably fixable thereto for rotation therewith. The amount of feed of the printing sheet can be easily changed by circumferentially changing the position of the blanket cylinder with respect to the impression cylinder, without changing the circumferential position of the blanket cylinder relative to the plate cylinder. Similarly, the circumferential position of the plate cylinder relative to the blanket cylinder can also be changed to adjust the position of the printed image on the printing sheet in the direction of the length of the sheet.

3 Claims, 6 Drawing Sheets

OFF-SET PRINTING MACHINE FOR PRINTING CONTINUOUS WEB

BACKGROUND OF THE INVENTION

1. Field of the Invention

This invention relates generally to an off-set printing machine for printing a continuous web or slip, and more particularly to such a printing machine incorporating means for adjusting the positions of plate, blanket and impression cylinders relative to one another.

2. Prior Art

Conventionally, the printing of business forms has been carried out by high-speed business form-printing rotary presses.

Such a business form-printing rotary press is quite large in size and requires much time for the exchange of printing patterns and adjustments. Further, during the time when the necessary adjustments are made for the pattern exchange, a large loss of the printing sheet is produced. To overcome these difficulties, various handy printing machines or presses have been proposed, particularly for the printing of a small lot of a continuous slip.

Generally, with such business form-printing machines, the plate, blanket and impression cylinders do not need to be exchanged in accordance with the size of the printing sheet to be used. In such example as disclosed in Japanese Kokai No. 62-64552, a continuous printing sheet is supplied between a pair of opposed, rotating blanket and impression cylinders, and one of the blanket and impression cylinders is brought into engagement with the other at a predetermined timing, so that a continuous printing sheet (continuous slip) is intermittently fed at such predetermined timing to effect the printing. Another example is known in which recesses or notches, formed respectively in peripheral surfaces of the blanket and impression cylinders, are circumferentially displaced with respect to each other to change the amount of feed of the printing sheet, so that the printing sheet is intermittently fed a required amount to print the printing sheet.

A conventional off-set printing machine of the latter type includes three gears 1*a*, 2*a* and 3*a* mounted respectively on plate, blanket and impression cylinders 1, 2 and 3, as shown in FIG. 1. When a recess 2*b* in the peripheral surface of the blanket cylinder 2 is circumferentially displaced with respect to a recess 3*b* in the peripheral surface of the impression cylinder 3, as shown in FIGS. 2A and 2B, a recess 1*b* in the peripheral surface of the plate cylinder 1 must also be circumferentially displaced with respect to the recess 2*b* of the blanket cylinder 2 by an amount corresponding to the amount of displacement of the recess 2*b* from the recess 3*b*. To achieve this position adjustment, the gears 1*a* and 2*a* are rotatably mounted on the plate and blanket cylinders 1 and 2, respectively, and are normally fixed or coupled by suitable fastening means to the respective cylinders 1 and 2 for rotation therewith. On the other hand, the gear 3*a* is fixedly mounted on the impression cylinder 3 for rotation therewith. The adjustment of the position of the plate cylinder 1 relative to the blanket cylinder 2 is necessitated because when it is desired to print a printing pattern j smaller in size than the maximum printing surface i of each cylinder (FIGS. 2A and 2B), a smudge 4 of the ink on the plate cylinder on the trailing side 5 of the printing plate (not shown) is transferred to the printing surface of the blanket cylinder 2 as at 6 (FIG. 3). As a result, the smudge 6 on the blanket cylinder 2 is transferred to the continuous printing sheet 7 as shown in FIG. 3, which adversely affects the quality of the printed material.

Also, in an off-set printing machine of this general type, the above-mentioned smudge 4 on the trailing side of the printing plate is unavoidable since the printing is carried out, maintaining a well-balanced relation between the ink and water. To solve this problem, conventionally, the arc spanned by the recess 1*b* of the plate cylinder 1 has been made smaller than that of the recess 2*b* of the blanket cylinder 2, as shown in FIG. 4.

SUMMARY OF THE INVENTION

With the above deficiencies of the prior art in view, it is an object of this invention to provide an off-set printing machine for printing a continuous slip which is capable of changing the amount of feed of a printing sheet merely by circumferentially changing the position of a blanket cylinder relative to an impression cylinder without changing the position of the blanket cylinder relative to a plate cylinder, thereby preventing any smudge of the ink on the trailing side of a printing plate from being transferred to the printing sheet, the printing machine being also capable of changing the position of an image to be printed on the printing sheet in the direction of the length of the printing sheet.

According to the present invention, there is provided an off-set printing machine for printing a continuous slip which comprises rotatable plate, blanket, and impression cylinders disposed parallel to one another, a first pair of gears in mesh with each other, one of them being fixedly mounted coaxially on one of the blanket and impression cylinders for rotation therewith, the other gear being rotatably mounted coaxially on the other of the blanket and impression cylinders and being fixable to the other cylinder for rotation therewith, and a second pair of gears in mesh with each other, one of them being fixedly mounted coaxially on one of the blanket and plate cylinders for rotation therewith, the other of them being rotatably mounted coaxially on the other of the blanket and plate cylinders and being fixable thereto for rotation therewith.

Since one of the first pair of gears is rotatable with respect to its mating cylinder, the circumferential position of the blanket cylinder with respect to the impression cylinder can be changed merely by angularly moving the former relative to the latter, without changing the circumferential position of the blanket cylinder relative to the plate cylinder. Thus, the amount of feed of a printing sheet can be changed easily and quickly in accordance with the size of the printing sheet to be printed. At this time, there is no need to change the circumferential position of the blanket cylinder with respect to the plate cylinder, since any smudge on the trailing side of the printing plate is not transferred to the blanket cylinder. Moreover, by virtue of the provision of the second pair of gears, the circumferential position of the plate cylinder relative to the blanket cylinder can also be changed to adjust the position of the printed image on the printing sheet in the direction of the length of the printing sheet. The above gear arrangement for changing the positions of the cylinders is simple in construction and therefore inexpensive.

DETAILED DESCRIPTION OF THE PREFERRED EMBODIMENTS

Figure 1:
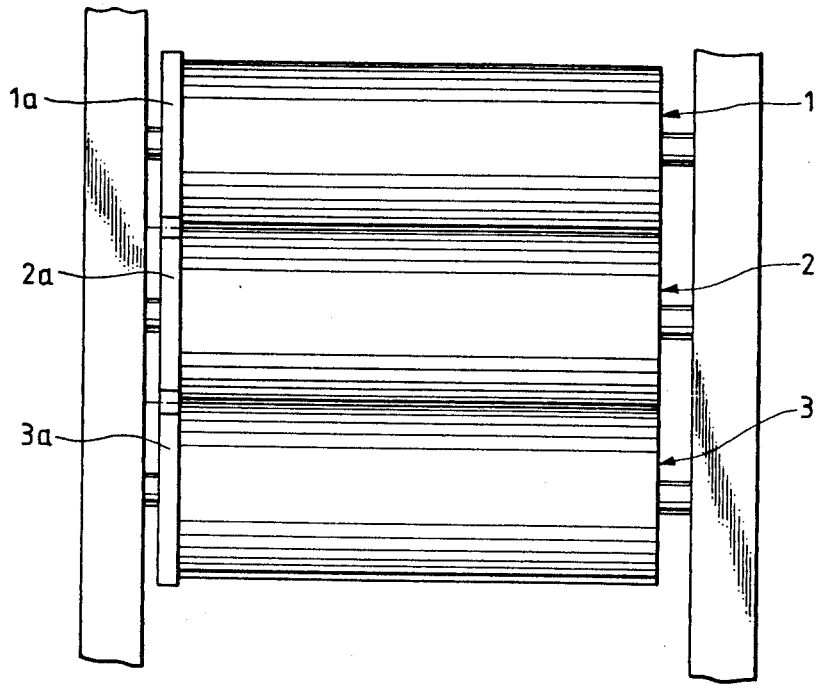
FIG. 1 (PRIOR ART)
FIG. 1 is a developed view of a gear arrangement of a conventional off-set printing machine for printing a continuous slip.
Figure 2B:
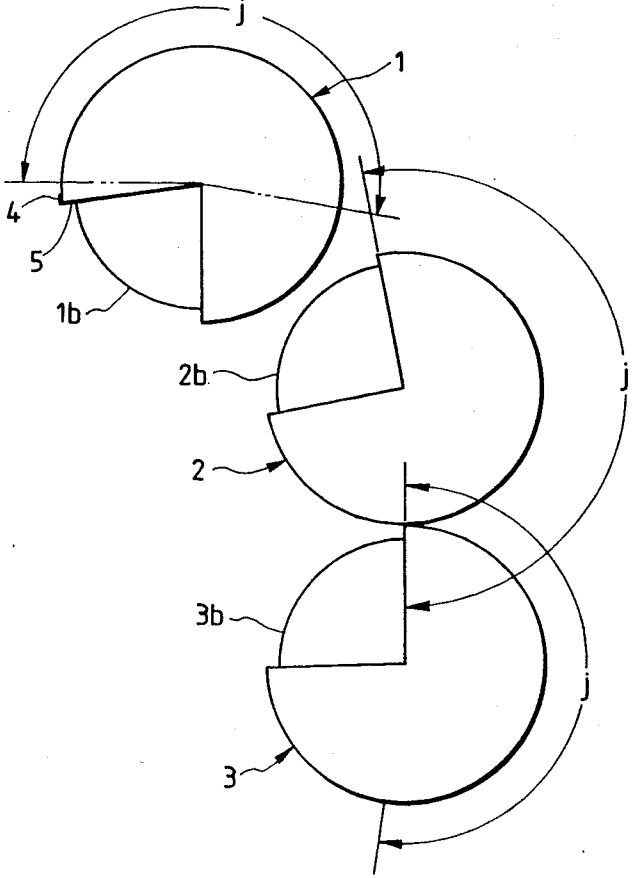
FIG. 2B (PRIOR ART)
FIGS. 2A and 2B are schematic views of cylinders of the conventional printing machine, explanatory of the changing of the amount of feed of a printing sheet by angularly moving an impression cylinder relative to a blanket cylinder.
Figure 2A:
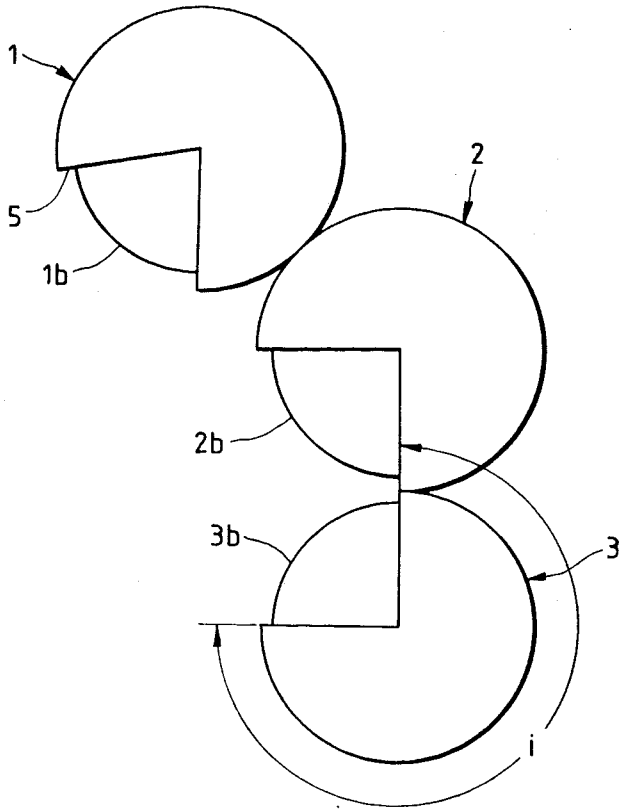
FIG. 2A (PRIOR ART)
Figure 3:
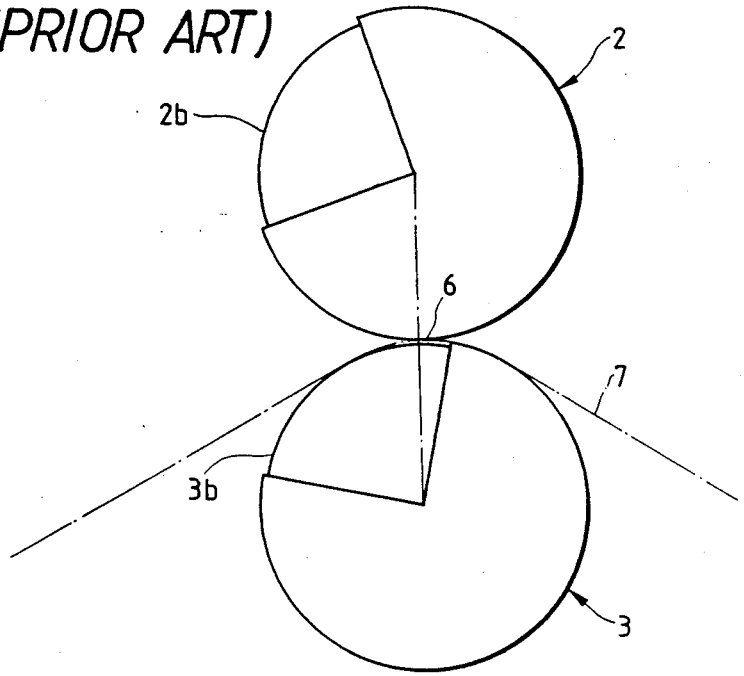
FIG. 3 (PRIOR ART)
FIG. 3 is a schematic view of the impression and blanket cylinders of the conventional printing machine in their printing condition when the amount of feed of the printing sheet is changed.
Figure 4:
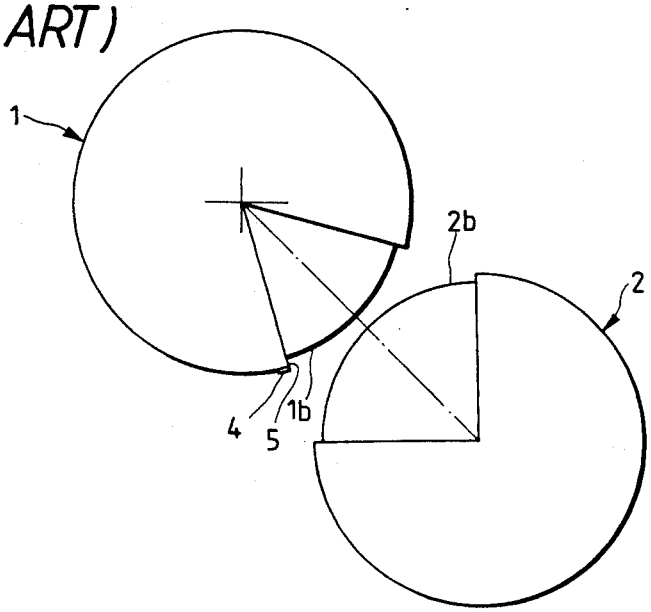
FIG. 4 (PRIOR ART)
FIG. 4 is a schematic view of the blanket cylinder and plate cylinder according to another example of the prior art.
Figure 5:
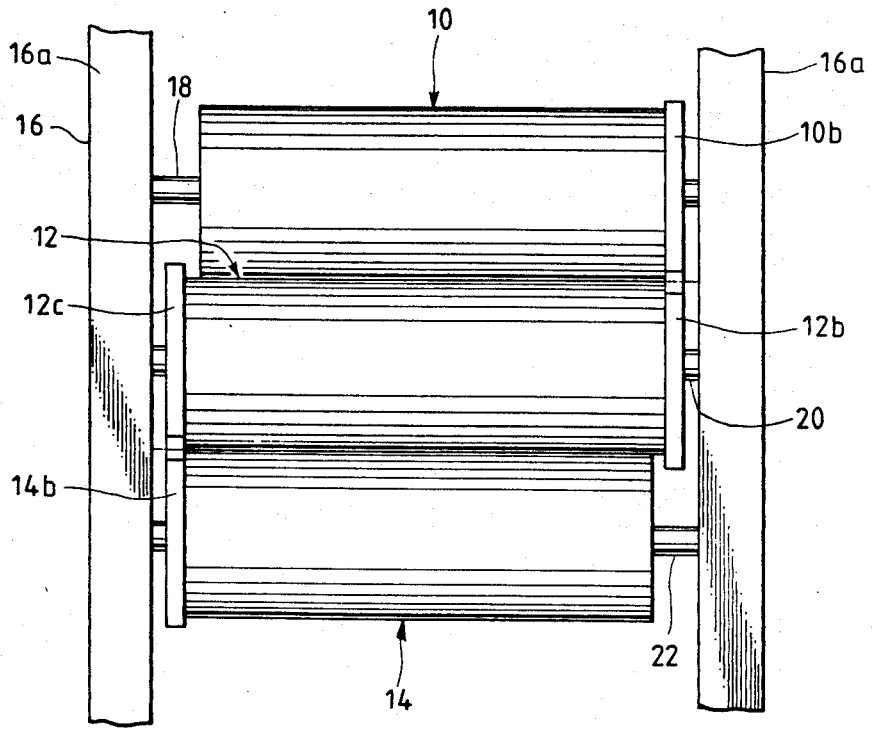
FIG. 5 is a developed view of a gear arrangement of an off-set printing machine for printing a continuous slip in accordance with the present invention.
Figure 6:
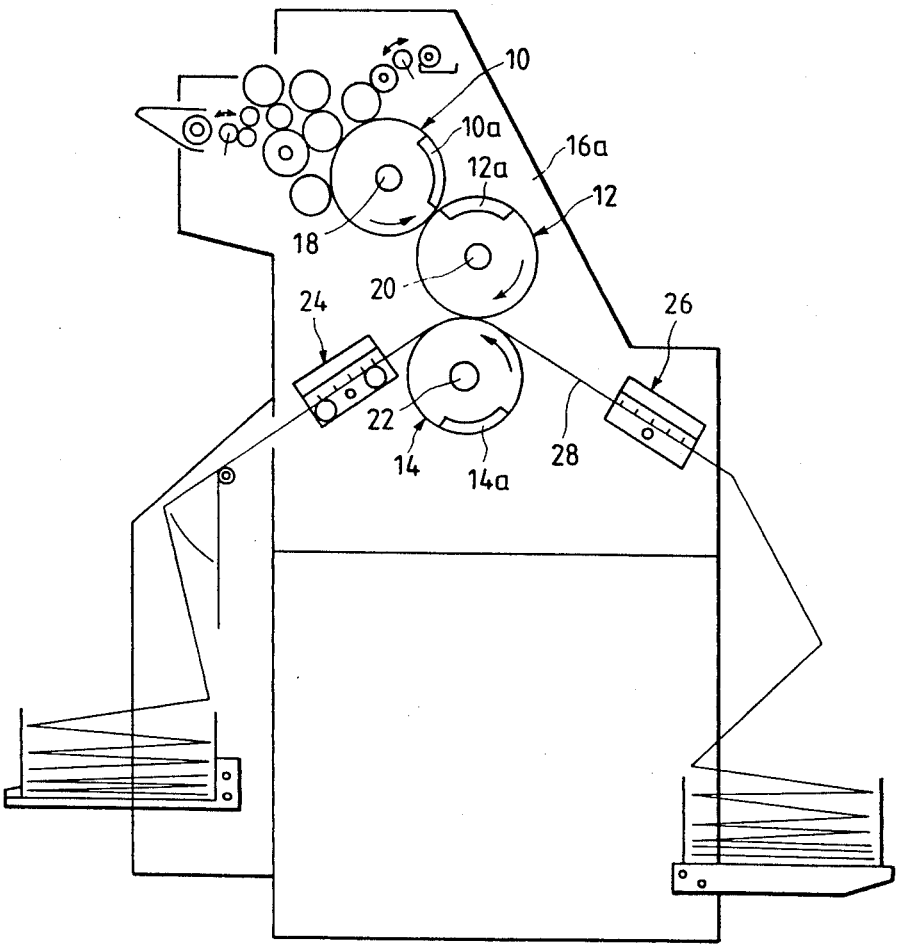
FIG. 6 is a schematic elevation view of the printing machine according to the invention.

The invention will now be described with reference to FIGS. 5 to 7. An off-set printing machine for printing a continuous slip comprises a plate cylinder 10, a blanket or rubber cylinder 12, and an impression cylinder 14 disposed adjacent to one another and detachably mounted on a pair of opposed walls 16*a* of a frame 16 by shafts 18, 20, and 22, respectively, which are disposed parallel to one another. A pair of tractors 24 and 26 are mounted on opposite sides of the impression cylinder 14 along the feed path of a continuous printing sheet 28 to control its feed. The printing sheet 28 is fed between the blanket and impression cylinders 12 and 14.

The plate, blanket and impression cylinders have recesses or notches 10*a*, 12*a* and 14*a* formed in and circumferentially extending along their peripheral surfaces, respectively. A first pair of gears 14*b* and 12*c* are coaxially mounted on one ends of the impression and blanket cylinders 14 and 12, respectively, and are in mesh with each other. A second pair of gears 12*b* and 10*b* are coaxially mounted on the other end of the blanket cylinder 12 and one end of the plate cylinder 10, respectively, and are in mesh with each other. One of each pair of gears is fixedly mounted on its mating cylinder while the other is rotatably mounted on its mating cylinder and is normally fixed thereto for rotation therewith, as will hereinafter more fully be described. One of these four gears is operatively connected to drive means such as a motor so that the plate, blanket and impression cylinders 10, 12 and 14 can be rotated in synchronism with one another at the same peripheral speed through these four gears. The amount of feed of the printing sheet 28 is determined by a circumferential length of contact over which the peripheral surface of the blanket cylinder 14 contacts the peripheral surface of the impression cylinder 12 per one revolution of each cylinder.

Figure 7B:
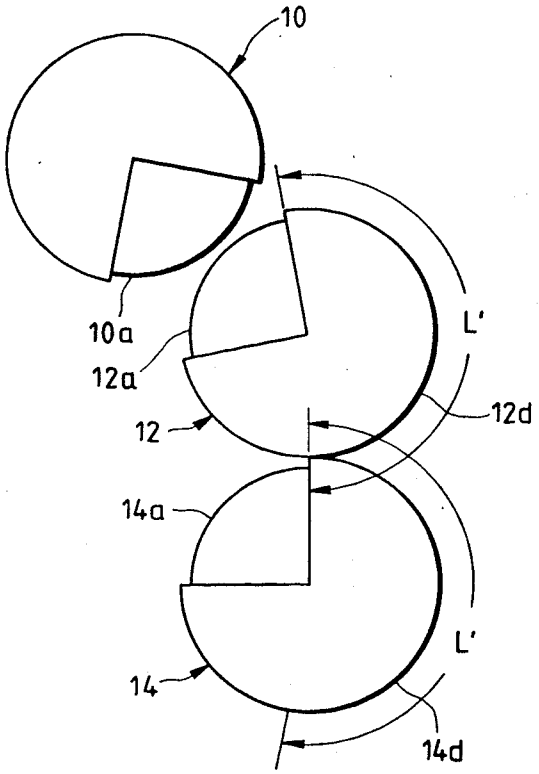
FIGS. 7A and 7B are schematic views of the cylinders of the printing machine of FIG. 6, explanatory of the changing of the amount of feed of a printing sheet by angularly moving an impression cylinder relative to a blanket cylinder.
Figure 7A:
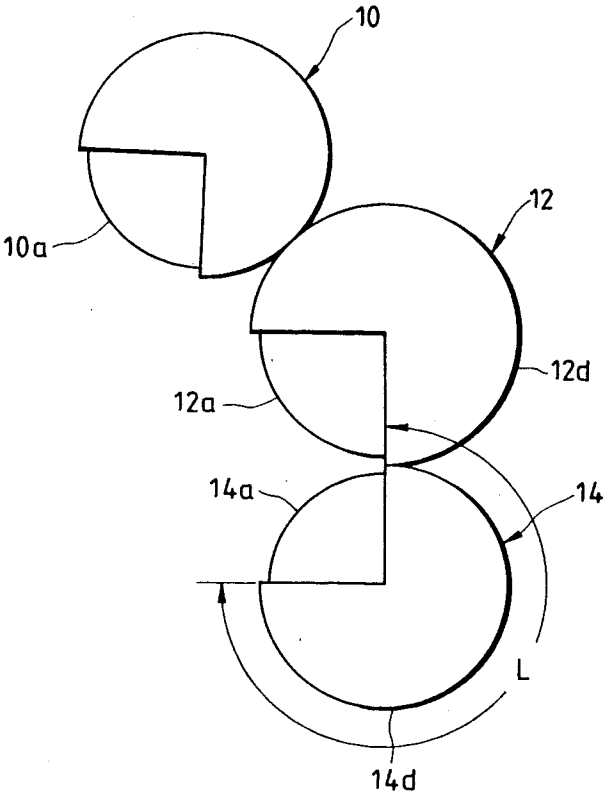

More specifically, as shown in FIG. 7A, the peripheral surfaces 12*d* and 14*d* of the blanket and impression cylinders 12 and 14, other than their respective recess 12*a* and 14*a*, serve as effective surfaces, and when the peripheral surfaces 12*d* and 14*d* contact each other throughout their entire lengths per one revolution of each cylinder, the maximum amount L of the feed of the printing sheet 28 corresponding to the length of the peripheral surface 12*d*, 14*d* is obtained. Because of the provision of the recesses 12*a* and 14*a* formed respectively in the blanket and impression cylinders 12 and 14, except when the peripheral surfaces 12*d* and 14*d* are in contact with each other, no pressure is applied to the printing sheet 28, so that the printing sheet 28 is not fed. As shown in FIG. 7B, when a printing image to be printed on the printing sheet 28 has a length L' less than the maximum amount L of feed, the blanket cylinder 12 is angularly moved about the axis thereof relative to the impression cylinder 14 in a clockwise direction, so that the recess 12*a* in the blanket cylinder 12 is circumferentially displaced with respect to the recess 14*a* in the impression cylinder 14, thereby changing the circumferential length of contact between the peripheral surfaces 12*d* and 14*d* of the blanket and impression cylinders 12 and 14 to a length corresponding to the length L'. In this manner, the amount of feed of the printing sheet 28 is effected.

To achieve this positional arrangement or adjustable displacement, one of the first pair of meshed gears 14*b* and 12*c* is rotatably mounted on its mating cylinder for circumferentially changing the position of the one gear with respect to its mating cylinder, whereas the other gear is fixedly mounted on its mating cylinder for rotation therewith. Also, similarly, to adjust the position of the printed image on the printing sheet 28 in the direction of the length of the printing sheet 28, one of the second pair of meshed gears 12*b* and 10*b* is rotatably mounted on its mating cylinder for circumferentially changing the position of the one gear with respect to its mating cylinder, whereas the other gear is fixedly mounted on its mating cylinder for rotation therewith.

This gear arrangement will now be described by way of the following examples:

Example 1

The gear 14*b* is fixedly mounted on the impression cylinder 14 for rotation therewith. The gear 12*c* is rotatably and adjustably mounted on the blanket cylinder 12 to permit a relative rotation therebetween, and is normally fixed relative to the blanket cylinder 12 for rotation therewith. The gear 12*b* is fixedly mounted on the blanket cylinder 12 for rotation therewith. The gear 10*b* is rotatably and adjustably mounted on the plate cylinder 10 to permit a relative rotation therebetween, and is normally fixed with respect to the plate cylinder 10 for rotation therewith.

Example 2

The gear 14*b* is rotatably and adjustably mounted on the impression cylinder 14 to permit a relative rotation therebetween, and is normally fixed with respect to the impression cylinder 14 for rotation therewith. The gear 12*c* is fixedly mounted on the blanket cylinder 12 for rotation therewith. The gear 12*b* is rotatably and adjustably mounted on the blanket cylinder 12, and is normally fixed with respect to the blanket cylinder 12 for rotation therewith. The gear 10*b* is fixedly mounted on the plate cylinder 10 for rotation therewith.

Example 3

The gear 14b is rotatably and adjustably mounted on the impression cylinder 14, and is normally fixed with respect to the impression cylinder 14. The gear 12c is fixedly mounted on the blanket cylinder 12. The gear 12b is fixedly mounted on the blanket cylinder 12. The gear 10b is rotatably and adjustably mounted on the plate cylinder 10, and is normally fixed relative to the plate cylinder 10.

Thus, there are three examples of the gear arrangement. Although not shown in the drawings, each adjustable gear rotatable with respect to its mating cylinder is normally fixed thereto by suitable fastening means. Referring to one example of such fastening means, an arcuate slot is formed through each adjustable gear and extends circumferentially. A plurality of threaded holes are formed in the end face of each of those cylinders on which the respective adjustable gears are mounted, the threaded holes being spaced circumferentially from one another along the slot. A bolt is passed through the slot into a selected one of the threaded holes, and is tightened to firmly fix the adjustable gear to its mating cylinder so that they can be rotated in unison.

The manner of changing the amount of feed of the printing sheet 28 will now be described with respect to the above-mentioned Example 1. First, the rigid connection between the adjustable gear 12c and the blanket cylinder 12 is released to permit relative rotation therebetween. Then, in accordance with a desired amount of feed of the printing sheet 28, the impression cylinder 14 is angularly moved about its axis together with its mating fixed gear 14b and the adjustable gear 12c in mesh therewith. At this time, the blanket cylinder 12 as well as the plate cylinder 10 remain stationary. As a result, the recess 14a in the impression cylinder 14 is circumferentially displaced with respect to the recess 12a in the blanket cylinder 12. Finally, the adjustable gear 12c is again rigidly connected by the fastening means to the blanket cylinder 12 for rotation therewith. Thus, the circumferential position of the impression cylinder 14 with respect to the blanket cylinder 12 can be changed without changing the circumferential position of the blanket cylinder 12 with respect to the plate cylinder 10. Therefore, any smudge on the trailing side of the printing plate (not shown) around the plate cylinder 10 is not transferred to the blanket cylinder 12 and hence to the printing sheet 28. In addition, if printing plates are made, using as a reference that portion of the plate cylinder 10 gripping the trailing end of the printing plate, a precise register is obtained.

Similarly, in each of the above-mentioned Examples 2 and 3, the rigid connection between the adjustable one of the first pair of gears 14b and 12c and its mating cylinder is released, and the position of the impression cylinder 14 is circumferentially changed with respect to the blanket cylinder 12, as described above for Example 1.

When it is required to adjust the position of the printed image on the printing sheet 28 in the direction of the length of the printing sheet 28, this adjustment is carried out in the following manner:

With respect to Examples 1 and 3, the plate cylinder 10 is held against rotation, and the rigid connection between the adjustable gear 10b and the plate cylinder 10 is released to permit relative rotation therebetween. Then, the blanket cylinder 12 is rotated or angularly moved a required amount relative to the plate cylinder 10, together with the adjustable gear 10b and the fixed gear 12b in mesh therewith. Thereafter, the adjustable gear 10b is again fixed to the plate cylinder 10 by the fastening means.

With respect to Example 2, the blanket cylinder 12 is held against rotation, and the rigid connection between the adjustable gear 12b and the blanket cylinder 12 is released to permit relative rotation therebetween. Then, the adjustable gear 12b is rotated or angularly moved to angularly move the plate cylinder a required amount through the meshed gears 12b and 10b. Thereafter, the adjustable gear 12b is again fixed to the blanket cylinder 12.

What is claimed is:

1. An off-set printing machine for printing a continuous web (28) comprising:

(a) a rotatable plate cylinder (10);

(b) a rotatable blanket cylinder (12);

(c) a rotatable impression cylinder (14); said plate, blanket and impression cylinders being rotatably mounted between opposite walls of a frame and in parallel to one another;

(d) a first pair of gears (12c, 14b) in mesh with each other, one (14b) of said pair of gears being fixedly mounted coaxially on said impression cylinder for rotation therewith, and the other gear (12c) being rotatably mounted coaxially on said blanket cylinder; means for releasably mounting said other gear to said blanket cylinder for allowing angular adjustment of said other gear relative to said blanket cylinder and for fixing said other gear to said blanket cylinder for rotation therewith; and (e) a second pair of gears (12b, 10b) in mesh with each other, said second pair of gears being located on an opposite side of said cylinders with respect to said first pair of gears; one (12b) of said second pair of gears being fixedly mounted coaxially on said blanket cylinder for rotation therewith, and the other (10b) of said second pair of gears being rotatably mounted coaxially on said plate cylinder; and means for releasably mounting said other gear of said second pair of gears to said plate cylinder for allowing angular adjustment of said last-mentioned other gear relative to said plate cylinder and for fixing said last-mentioned other gear to said plate cylinder for rotation therewith; and (f) wherein the amount of feed of the web may be changed by adjusting the relative angular position of the blanket cylinder with respect to the impression cylinder by relative angular adjustment of said other gear of said first pair of gears, and the position of a printed image on the web may be changed by adjusting the relative angular position of the plate cylinder with respect to the blanket cylinder by relative angular adjustment of said other gear of said second pair of gears.

2. A printing machine according to claim 1, wherein each cylinder has an outer peripheral recess spanning a portion of the circumference thereof.

3. A printing machine according to claim 2, wherein the cylinders are of equal diameter and each recess spans a substantially equal arc.

* * * * *